United States Patent [19]

Ehrenfeld, Jr.

[11] Patent Number: 4,500,319

[45] **Date of Patent: * Feb. 19, 1985**

[54] TEXTURED PILE FABRICS

[75] Inventor: Frank E. Ehrenfeld, Jr., Morrisville, Pa.

[73] Assignee: Congoleum Corporation

[ * ] Notice: The portion of the term of this patent subsequent to Jul. 20, 1999 has been disclaimed.

[21] Appl. No.: 367,211

[22] Filed: Apr. 9, 1982

Related U.S. Application Data

[63] Continuation of Ser. No. 15,297, Feb. 26, 1979, Pat. No. 4,340,381, which is a continuation-in-part of Ser. No. 616,307, Sep. 24, 1975, abandoned, which is a continuation of Ser. No. 492,011, Jul. 26, 1974, abandoned, which is a continuation of Ser. No. 267,227, Jun. 28, 1972, abandoned, which is a continuation of Ser. No. 64,475, Aug. 17, 1970, abandoned.

[51] Int. Cl.[3] ..... D06M 3/30

[52] U.S. Cl. ..... 8/114.5

[58] Field of Search ..... 8/491, 485, 114.5

[56] References Cited

U.S. PATENT DOCUMENTS

| | | | |
|---|---|---|---|
| 556,794 | 3/1896 | Wissel et al. | 8/114.6 |
| 705,977 | 7/1902 | Timme | 117/9 |
| 1,485,790 | 3/1924 | Luttin | 8/601 |
| 1,834,339 | 12/1931 | Dreyfus | 8/114.6 |
| 1,980,191 | 11/1934 | Dickie et al. | 41/41 |
| 2,020,303 | 11/1935 | Dreyfus | 28/1 |
| 2,020,698 | 11/1935 | Platt | 28/2 |
| 2,110,866 | 3/1938 | Castles | 8/115 |
| 2,790,225 | 5/1954 | Cogovan | 28/72 |
| 2,875,504 | 3/1959 | White | 28/72 |
| 2,901,373 | 8/1959 | Weiss | 117/9 |
| 2,904,840 | 9/1959 | Hochreuter | 18/48 |
| 3,053,609 | 9/1962 | Miller | 8/128 |
| 3,069,222 | 12/1962 | Hermes | 8/130.1 |
| 3,083,069 | 3/1963 | Hirsbrunner et al. | 8/54 |
| 3,228,745 | 1/1966 | Galatioto | 8/130.1 |
| 3,236,586 | 2/1966 | Humphreys | 8/130.1 |
| 3,236,587 | 2/1966 | Genereux | 8/130.1 |
| 3,467,484 | 9/1969 | Hermes | 8/15 |
| 3,475,771 | 11/1969 | Quynn | 8/173 |
| 3,505,000 | 4/1970 | Shinmura | 8/114.5 |
| 3,567,548 | 3/1971 | Miller | 156/277 |
| 3,797,996 | 3/1974 | Gregorian et al. | 8/114.5 |
| 3,856,598 | 12/1974 | Gregorian et al. | 156/85 |
| 3,901,649 | 8/1975 | Gregorian et al. | 8/114.5 |
| 3,961,882 | 6/1976 | Vits et al. | 8/17 |

FOREIGN PATENT DOCUMENTS

| | | |
|---|---|---|
| 47910/68 | 6/1970 | Australia . |
| 355836 | 9/1933 | Canada . |
| 889574 | 1/1972 | Canada . |
| 544820 | 4/1942 | United Kingdom . |
| 544821 | 4/1942 | United Kingdom . |
| 1227381 | 4/1971 | United Kingdom . |

OTHER PUBLICATIONS

Knecht et al., *The Principles and Practice of Textile Printing,* 4th Edition p. 31 (1952), Charles Griffin & Company Limited, 42 Drury Lane, London WC2, England ("Knecht").

*Nylon Technical Service Manual,* pp. 2-301 to 2-303 (1953); E. D. du Pont de Nemours & Co., Wilmington, Del.

Jacobs, Rebenfeld and Taylor, *Journal of Polymer Science,* vol. 13, pp. 127-136 (1969).

Dismore, P. F. and Statton, W. O., *Journal of Polymer Science,* B, 2, pp. 1113-1116 (1964).

*Primary Examiner*—Paul R. Michl

*Attorney, Agent, or Firm*—Richard T. Laughlin; Robert C. Beam; Daniel J. Reardon

[57] ABSTRACT

A pile fabric of synthetic fibers having a textured or embossed surface produced by selectively contacting the surface of said fabric with a chemical embossing agent, allowing the embossing action to occur, and thereafter effectively removing the embossing agent from the surface; said embossing serving to reduce the height of the pile in the treated areas and creating said textured appearance.

28 Claims, 2 Drawing Figures

TEXTURED PILE FABRICS

BACKGROUND OF THE INVENTION

This application is a continuation of application Ser. No. 015,297 filed Feb. 26, 1979 (issued as U.S. Pat. No. 4,340,381) which is, in turn, a continuation-in-part of copending application Ser. No. 616,307 filed Sept. 24, 1975 (now abandoned); which is a continuation of application Ser. No. 492,011 filed July 26, 1974 (now abandoned); which is, in turn, a continuation of application Ser. No. 267,227 filed June 28, 1972 (now abandoned); which is a continuation of application Ser. No. 064,475 filed Aug. 17, 1970 (now abandoned).

In the production of synthetic pile fabrics, it is often desirable to emboss the surface thereof in order to provide added decorative appeal. In some instances, the embossed areas are printed with dyes to further embellish the surface design.

Embossing of pile fabrics is conventionally accomplished with a heating embossing roll or plate which has been engraved or otherwise treated to create the design desired in raised relief on the surface. A method which eliminates the use of embossing rolls has been disclosed in U.S. Pat. Nos. 2,790,255 and 2,875,504.

In accordance with these patents, the pile fabric is formed from a combination of shrinkable and non-shrinkable yarns. Upon subjecting the fabric to the influence of heat, the pile formed from the shrinkable yarns contracts while the base and the non-shrinkable yarns remain intact thereby yielding a pile made up of high and low areas to give the appearance of an embossed or carved product.

A chemical embossing method is disclosed in U.S. Pat. No. 2,020,698. According to this patent, fabric having a pile of organic ester of cellulose yarn is treated locally with an alkali or alkaline salt saponifying agent in order to obtain ornamental differential effects in the treated areas. Furthermore, since the organic ester of cellulose pile yarns that have not been saponified are more difficult to change from their position, after they are once set than are the saponified organic ester of cellulose yarns, it is possible to obtain a differential lay between the saponified and unsaponified organic ester of cellulose pile yarn. Thus, the fabric, after the application of the saponifying agent, may be washed, finished and dried with the pile erect, after which the fabric may be run through water and brushed across the piece to lay the pile towards the selvage and is then dried. This causes the saponified pile yarn to lie flat while the unsaponified yarn remains substantially erect. Upon subsequent steaming and cross-brushing the fabric in the opposite direction, any unsaponified yarn which may have been slightly bent from the vertical by the previous brushing toward the selvage is caused to stand erect without disturbing the position of the laid or crushed saponified organic ester of cellulose pile yarn.

SUMMARY OF THE INVENTION

It is the primary object of this invention to provide a simple process for producing a synthetic pile fabric having a textured or embossed surface. Another object is to provide such a process which is readily adaptable to standard printing equipment. Another object is to provide a process which allows the production of pile fabric having embossed areas in register with a printed design. A further object is to provide an embossing process which is readily adaptable to curved and irregular surfaces. A still further object is to provide a novel, embossed pile fabric. Various other objects and advantages of this invention will be apparent from the following detailed description thereof.

It has now been discovered that it is possible to produce superior pile fabrics having embossed surfaces by contacting selected portions of the surface with a chemical embossing agent for the fibers of said pile fabric causing dimensional change by linear contraction of the treated fibers and thereafter effectively removing the embossing agent. The resulting product is thus depressed at the treated areas.

The embossing composition can be transparent so that the appearance of the product is not altered other than in being embossed. Alternately, the embossing agent can be part of a dye or pigment composition so that the color appears in the areas of embossing agent application.

The depth of the depressed areas can be controlled by varying the concentration and/or type or embossing agent. This varied concentration can be effected by the amount of vehicle applied as well as by the strength of the embossing reagent.

Furthermore, the embossed depth can be controlled by varying the temperature to which the pile fabric is subjected in order to activate the chemical embossing agents which provide the desired effect.

This discovery makes possible the production of a product having embossed surfaces which can be in complete register with a printed design. Additionally, the discovery makes possible the utilization of many types of printing apparatus for purpose of affecting embossing, thereby eliminating the need for expensive embossing equipment. Further, it allows the embossing of a surface without exerting sufficient pressure to permanently deform the pile fabric. A great number of products can be produced by the process. It can be used for producing floor, wall and ceiling coverings, drapery, upholstery and the like, and, in fact wherever such pile fabrics are utilized. It is readily adaptable to decorating any surface on which pile fabrics can be applied. Many additional applications will occur to those skilled in the art.

This invention will be better understood from the following detailed description thereof together with the accompanying self-explanatory drawing in which:

FIG. 1 is an enlarged top view of a section of an embossed product of this invention; and, FIG. 2 is an enlarged cross-sectional view of the same product taken through line 2—2.

DESCRIPTION OF THE PREFERRED EMBODIMENTS

Figure 1:
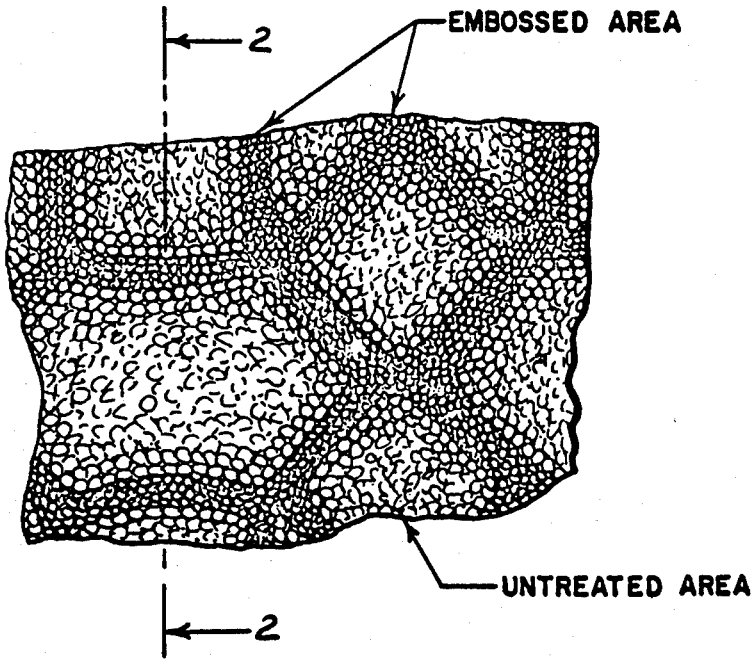
Figure 2:
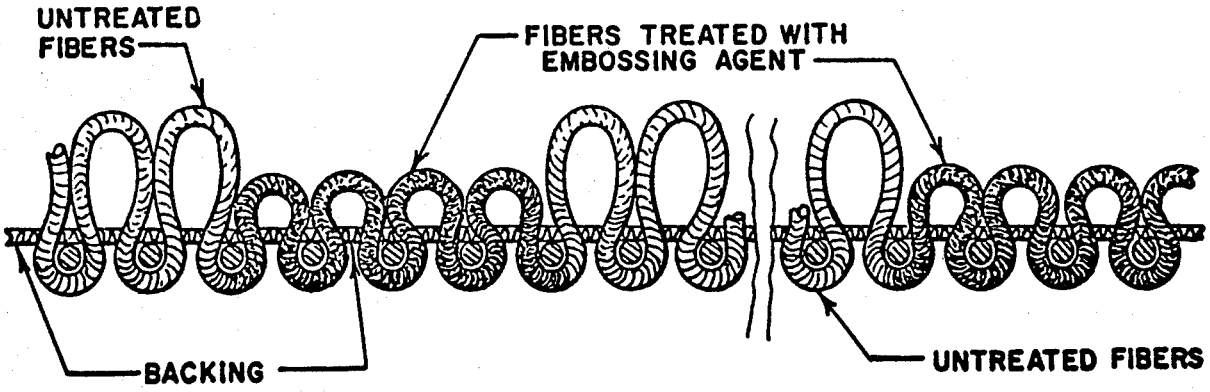

In the production of the pile fabrics of this invention the pile yarns employed are the polyamides such as nylon.

Likewise, the embossing agents which are applied to the fibers in order to produce the desired effect are also known. For purposes of this invention, the term "embossing agent" is defined as any active chemical composition which when applied to the pile fabric produces a measurable reduction of pile height involving linear contraction of the fibers, and includes, among others, substances which are known to be swelling agents for the specified synthetic fibers.

In order to be applicable for the novel process of this invention, the ideal embossing agent should provide alteration, and indeed, irreversible alteration, of the fiber dimensions through the chemical reaction described hereinabove, should not adversely affect the printing means, e.g. print screens, and should be capable of being substantially removed or inactivated subsequent to the embossing action. Other characteristics of the embossing agent which are desirable, though not essential, include compatibility with dye print pastes, the capability of being regulated by factors of time, temperature and concentration, i.e. being susceptible to activation by a conventional steaming operation and exhibiting no residual embossing activity. Needless to say, minor adjustments in the nature of the components and process conditions, and/or the embossing apparatus can overcome the absence of certain of these desired characteristics.

Thus, embossing agents effective on nylon include halogenated acetic acids such as chloroacetic and trifluoroacetic acids.

The embossing agent for the synthetic fibers is applied to one surface of the pile fabric in any desired design, whether it be random or predetermined. One of the easiest methods of applying the agent is by utilizing some of the conventional printing techniques such as screen or block printing. The embossing agent can be applied as a concentrate, as part of a transparent vehicle, or as part of any dye utilized for pile fabric printing. The nature of the embossing agent dictates the nature of the vehicle to be utilized. Among such applicable vehicles are included: water, and alcohols such as methanol and isopropanol. Often thickeners e.g. gums, are included in order to obtain viscosity characteristics demanded in print technology and to enable the embossing agent to adhere to and operate on the synthetic fiber and to hold the printed pattern.

In those instances where it is desired to achieve a single- or multi-colored printed decoration with a distinct color for the embossed areas, the embossing agent can be incorporated into a particular dye or pigment composition. The dye or pigment will generally be in the form of a print paste ink to which the appropriate amount of agent is added. It is to be noted that in preparing these modified dye compositions, the pH levels, viscosities, and dye concentrations which are essential to an efficient dyeing operation must also be controlled. The resultant effect is an embossed design in register with the printed pattern.

As previously indicated, the preferred embossing agent is one which is dormant during the successive printing operations but then is activated by the elevated temperature of a steam chamber usually utilized to fix the dye onto the fibers. Embossing agents which can function in this manner include chloroacetic acid on nylon fibers. The advantages of this type of embossing agent are that there is no need for rigid time control and there is minimal concern regarding excessive, uncontrollable embossing.

The total amount of embossing agent brought into contact with the fiber will determine in large measure the degree of embossing. Thus, the degree of diminution of the pile height can be controlled by adjusting the amount of dye paste applied, the concentration of embossing agent in the dye and the temperature and time of exposure in the steam chamber. All these factors can be adjusted according to the nature of the fiber comprising the pile fabric. While the depth of embossing will be determined by the practitioner in accordance with the type of embossed product being prepared, reduction in pile height will generally not exceed 50%, the latter value being indicative of excellent embossing without exposing the backing materials.

Depth of penetration and rapidity of action can, if desired, be increased by subjecting the treated fibers to heat for short periods of time. Thus, the treated surfaces may be subjected to the radiation from a bank of infrared lamps, particularly where the embossing agent is not part of a dye print paste. Additionally, even where the steaming operation is not essential to activate the embossing agent, such steaming may have the effect of increasing the penetration of the embossing agent and increasing the speed of its action on the fibers.

The second critical step of the novel process of this invention involves terminating the embossing action and effecting substantial removal of the embossing agent from the pile fabric. The organic acids require actual termination or a degree of removal sufficient to avoid continued attack on the fibers by residual amounts of the embossing agent. It may be necessary to achieve complete elimination of all residues of the embossing process which may contribute undesirable properties to the finished fabric, such as odor, toxicity and color change. Needless to say, any termination or quenching technique resorted to will depend on the particular embossing agent employed. The most expedient technique for removing residues of the embossing process is by thoroughly washing the fabric with water and detergents. In those instances where the embossing agent is part of a dye or pigment composition, the washing cycle which is utilized to remove excess dye or pigment may also be used to remove traces of the agent. With the acidic embossing agents utilized, e.g. chloroacetic acid on nylon, it is possible to halt the embossing action more rapidly by rinsing with an aqueous ammonia or mildly alkaline solution. This neutralization of the acid serves to insure the total removal thereof.

Other techniques for terminating the embossing action and/or removing the embossing agent include evaporation and dry cleaning. Thus, if the agent is volatile, steaming of the treated pile fabric will serve to evaporate a large portion of the embossing agent content. Where rinsing techniques are not effective, it may be necessary to resort to a dry cleaning procedure to remove the embossing residues.

The invention has particular application to tufted carpets which have a printed decoration applied thereon. Unusual design effects can also be obtained when the pile fabric is printed with a multi-colored design wherein one or more of the dye compositions contain the appropriate embossing agent. The process of printing such carpets includes the steps of passing carpets, tufted or unpigmented or colored fibers, into a screen printing apparatus whereby a design is printed on the surface of the carpet. Each screen applies a separate color to make up the final design. The proposed embossing agent can be added to one or more of these printing stations by addition to the dye composition, or it can be applied by a separate station in a transparent vehicle. The fabric is then passed into a steaming chamber to set the dyes followed by a washing cycle which serves to remove excess dye as well as to terminate the embossing action and/or remove the embossing components.

The following examples will further illustrate the embodiment of this invention. In these examples, all parts given are by weight unless otherwise noted.

EXAMPLE I

This example illustrates the preparation of an embossed pile fabric typical of the products of this invention.

Sections of a level loop carpet of the following construction were treated by means of screen printing techniques with a dye print paste containing 45 parts of chloroacetic acid embossing agent.

Carpet Construction

Face Weight-14 oz/sq. yd. 100% Nylon
Machine Gauge—5/64
Stitch Rate—13 stitches/in.
Pile Height—$\frac{1}{8}$"
Total Thickness—0.310 inches.

| | Print Paste | Parts |
|---|---|---|
| 1. | Embossing Agent | 45 |
| 2. | Locust Bean Gum Solution 5% Gum + 5% Benzyl Alcohol | 40 |
| 3. | Formic Acid | 1 |
| 4. | Thiodiglycol | 5 |
| 5. | Dye | As Desired |
| 6. | Water | 14 |

Little pile height reduction was noted until the carpet was steamed at 212° F. After steaming for ten minutes at 212° F. the carpet was rinsed, neutralized, given a nonionic scour, rinsed again and dried.

The resulting carpet exhibited an attractive textured surface with a 50% reduction in pile height in the treated areas.

EXAMPLE II (a) Additional embossed nylon carpets were prepared by means of the general procedure set forth in Example I hereinabove, utilizing the following embossing system.

| | |
|---|---|
| Embossing Agent | trifluoroacetic acid |
| Print Composition | 30% trifluoroacetic acid in a dye paste, the composition of which is recited hereinafter in (b) hereof. |
| Embossing Conditions | steaming at 212° F. for 10 minutes. |
| Results | excellent embossing, 50% reduction in pile height. |

(b) Additional embossed nylon carpets were prepared by means of the general procedure set forth in Example I, utilizing the following embossing system:

| | Dye Paste | Parts |
|---|---|---|
| 1. | Acidic embossing agent | 25 |
| 2. | Locust Bean Gum Solution 5% Gum + 5% Benzyl Alcohol | 32 |
| 3. | Formic Acid | 1 |
| 4. | Thiodiglycal | 5 |
| 5. | Dye | As Desired |
| 6. | Water | 37 |

A variety of halogenated acetic acid embossing agents and embossing conditions are readily applicable to the novel process of this invention.

Summarizing, it is thus seen that this invention provides a novel and effective method for embossing synthetic pile fabrics.

Variations may be made in procedures, proportions and materials without departing from the scope of the invention as defined in the following claims.

What is claimed is:

1. A process for producing an embossed effect on synthetic nylon pile fabric that comprises applying to at least certain of the upstanding nylon fibers incorporated in the pile of said fabric, a composition comprising a halogenated acetic acid in a concentration of at least about 25 percent by weight, and subjecting at least said fibers to an elevated temperature for a period sufficient to effect linear contraction thereof.

2. A process as claimed in claim 1 wherein said acid is chloroacetic acid.

3. A process as claimed in claim 2 wherein said acid is incorporated in a transparent vehicle therefor.

4. A process as claimed in claim 4 wherein said vehicle is a paste.

5. A process as claimed in claim 2 wherein a design is printed on certain of said fibers of said fabric and said acid is applied to those fibers of said fabric imprinted with said design and in registry therewith.

6. A process as claimed in claim 2 wherein said acid is incorporated in a composition including a dye print paste.

7. A process as claimed in claim 1, wherein said halogenated acetic acid is chloroacetic acid and said pile fabric is subjected to said elevated temperature in an environment of steam.

8. A process as claimed in claim 7 wherein said acid is permitted to remain in contact with said fibers for a period sufficient to reduce the height thereof by up to fifty percent.

9. A process as claimed in claim 2 wherein said shrinking agent is effectively removed from said fibers at the conclusion of said contact.

10. In a process for producing an embossed effect on a synthetic nylon pile fabric, the improvement that comprises applying to portions of the upstanding nylon pile of said fabric, a chemical shrinking agent for said pile comprising chloroacetic acid in a paste vehicle.

11. A process as claimed in claim 7, wherein said steam is applied at a temperature of at least 212° F.

12. A process as claimed in claim 11, wherein said steam is applied at a temperature of about 212° F.

13. A process as claimed in claim 11, wherein said steam is applied for a period of about 10 minutes.

14. A process as claimed in claim 7, wherein said pile fabric is subjected to said steam after application of said chloroacetic acid.

15. A process as claimed in claim 9, wherein said acid is chloroacetic acid present in a concentration of at least about 25 percent by weight.

16. A process as derived in claim 15, wherein said acid is present in a concentration of from 30 percent by weight to about 43 percent by weight.

17. A process as claimed in claim 13, wherein said acid is present in a concentration of about 43 percent by weight.

18. A process as claimed in claim 7 wherein said pile is carpet.

19. A process as claimed in claim 1 wherein said composition is a printing paste and said acid is chloroacetic acid.

20. A process as claimed in claim 19 wherein said printing paste incorporates a dye.

21. A process as claimed in claim 19 wherein said printing paste is transparent.

22. A process for producing a carpet comprising a nylon pile having a pattern printed thereon and the pattern having embossed areas and non-embossed areas in registry, comprising the steps of:

printing the carpet with at least one pattern component, using only a dye therein to provide the resulting pattern, moving the carpet to a sequential printing station wherein the previously at least one printed pattern component is in register with the subsequent pattern component of the sequential printing station to be printed, printing said subsequent pattern component in registry with the previously at least one pattern component wherein said subsequent pattern component comprises a printing ink containing a haloacetic acid in a concentration sufficient, when steamed, to shrink the carpet fibers, then when all of the pattern components have been printed on the carpet, applying steam to the carpet to shrink the fibers affected by the haloacetic acid employed as a shrinking agent to produce an embossed effect in the areas printed with said haloacetic acid and to set the dyes in the carpet, washing the carpet, and then drying the carpet to remove the water.

23. A process for producing an embossed effect on a carpet of synthetic nylon pile fabric that comprises applying to portions of the surface thereof, a chemical treating composition comprising a haloacetic acid, in a concentration sufficient to constitute a shrinking agent, and a dyeing agent, allowing said chemical treating composition to remain in contact with said fibers for a period of time and at an elevated temperature sufficient to dye said fibers and to reduce the height thereof by shrinkage, and thereafter effectively removing the chemical treating composition from the fabric, said reduction in height of the fibers in the contacted areas causing said embossed effect.

24. A process as claimed in claim 22 or 23 wherein said shrinking agent is chloroacetic acid.

25. A process for producing a carpet comprising a nylon pile having a pattern printed thereon and the pattern having embossed areas and non-embossed areas in registry, comprising the steps of:

printing at least one selected areas of the carpet with at least one dye-containing printing paste at at least one printing station;

thereafter printing said carpet at a succeeding printing station in registry with the at least one previously printed area thereof, with a printing paste including a halogen-containing acetic acid in a concentration sufficient to affect shrinkage or said carpet; and subsequently applying steam thereto to shrink the fibers affected by the shrinking agent to produce an embossed effect on the printed areas; and to set the dyes of said pattern components in said carpet.

26. The process of claim 25 wherein said haloacetic acid is chloroacetic acid.

27. A process as claimed in claim 24 wherein said acid is present in a concentration of at least 25 percent.

28. A process as claimed in claim 25 wherein said acid is chloroacetic acid present in a concentration of from 30 percent by weight to about 43 percent by weight.

* * * * *